US012583559B2

(12) United States Patent
Lemon

(10) Patent No.: US 12,583,559 B2
(45) Date of Patent: Mar. 24, 2026

(54) WATERCRAFT PORTAGE APPARATUS AND METHOD OF USE

(71) Applicant: Joshua Lemon, Woodbridge, CT (US)

(72) Inventor: Joshua Lemon, Woodbridge, CT (US)

( * ) Notice: Subject to any disclaimer, the term of this patent is extended or adjusted under 35 U.S.C. 154(b) by 812 days.

(21) Appl. No.: 17/854,349

(22) Filed: Jun. 30, 2022

(65) Prior Publication Data

US 2024/0002022 A1 Jan. 4, 2024

(51) Int. Cl.
*B63B 34/26* (2020.01)
*B63C 13/00* (2006.01)

(52) U.S. Cl.
CPC ..... *B63B 34/26* (2020.02); *B63C 13/00* (2013.01)

(58) Field of Classification Search
CPC ..... B63B 34/00; B63B 34/26; B63B 17/00; B63B 17/02; B63B 34/20; B63B 29/00; B63B 29/04; B63C 13/00
USPC ..... 114/347
See application file for complete search history.

(56) References Cited

U.S. PATENT DOCUMENTS 4,873,935 A * 10/1989 Lustig ..... B63B 34/20 114/347
5,495,968 A * 3/1996 Miller ..... B63C 13/00 114/364
5,875,946 A * 3/1999 Knudsen ..... A45F 3/15 114/347
D503,023 S * 3/2005 Holub ..... D34/28
7,562,635 B1 7/2009 Morris

FOREIGN PATENT DOCUMENTS

CA 2853354 A1 2/2015
CA 3028467 A1 6/2020

OTHER PUBLICATIONS

Boundary Waters Catalog, Yoke and Yoke Pads, web catalog, printed on Jul. 20, 2022, 7 pages, https://www.boundarywaterscatalog.com/canoe-gear-yokes-pads.
REI Co-Op, Lifting and Carrying a Canoe, web article, printed on Jul. 20, 20202, 7 pages, https://www.rei.com/learn/expert-advice/lifting-carrying-canoes.html.
Northstar Canoes, Yokes & Thwarts, web catalog, printed on Jul. 20, 2022, 9 pages, https://northstarcanoes.com/accessories/yokes-thwarts/.
canoeing.com, Yokes/Tumplines, web catalog, printed on Jul. 20, 2022, 3 pages, http://canoeing.com/product-category/canoe-gear/yokestumplines/.
Rutabaga Paddlesports, Yoke Pads, web catalog, printed Jul. 20, 2022, 3 pages, https://www.rutabagashop.com/collections/yoke-pads.
Jay S, Yoke Options, website, printed on Jul. 21, 2022, 2 pages, https://www.pinterest.ca/jjstevenson5/yoke-options/.
(Continued)

*Primary Examiner* — Lars A Olson
(74) *Attorney, Agent, or Firm* — UConn IP Law Clinic; Robert Bertekap, III; Autumn A. Twillie

(57) ABSTRACT

A canoe yoke is provided that includes an elongated member at least a portion of which is covered by a cushioning member. The yoke addresses problems associated with single user transport of a canoe or other watercraft over land. The canoe yoke combines aspects of strength, ease of installation, and ease of storage that are better than other options known to the art.

20 Claims, 16 Drawing Sheets

(56) References Cited

OTHER PUBLICATIONS

Amazon, Kayak Carry Handles with Pull T-Handle Kayak Deck Rigging Accessory for Kayak Canoe Boat with Screws, web catalog, printed on Jul. 21, 2022, 2 pages, https://www.amazon.com/Kayak-Handles-T-Handle-Thread-Screws/dp/B08HLZMKGQ/ref=asc_df_B08HLZMKGQ/?tag=hyprod-20&linkCode=df0&hvadid=475844257628&hvpos=&hvnetw=g&hvrand=4442454868948689016&hvpone=&hvptwo=&hvqmt=&hvdev=c&hvdvcmdl=&hvlocint=&hvlocphy=1016367&hvtargid=pla-995545043450&psc=1.
Swift, Packable Yoke, web catalog, printed on Jul. 20, 2022, 1 page, https://swiftcanoe.com/product/packable-yoke/.
Conninsville Canoe & Kayak, Swift Packable Fabric Yoke, web catalog, printed on Jul. 20, 2022, 3 pages, https://www.collinsvillecanoe.com/shop/c/p/Swift-Packable-Fabric-Yoke-x47084402.htm.
Swiftcanoekayak, Check Out The New Swift Accessory Line!, web video, May 7, 2020, 4 pages, https://www.youtube.com/watch?v=IcfHn_wKr6I.
Pinemartyn, A Quick and Easy DIY Portage Yoke, web video, Sep. 28, 2018, 5 pages, https://www.youtube.com/watch?v=wSgvulhDFA0.
The Bear Mountain Boat Shop, Solo Canoe Portage Yoke, web article, printed on Jul. 20, 2022, 3 pages, http://buildersforum.bearmountainboats.com/viewtopic.php?t=3861.
Ashes Still Water Boats, Yoke and thwart Templates, web article, printed on Jul. 20, 2022, 7 pages, https://ashesstillwaterboats.com/yoke-and-thwart-templates/.
Paddling Light, Solo Canoe Yoke Plans for Portaging, web catalog, printed on Jul. 20, 2022, 4 pages, https://www.paddlinglight.com/product/solo-canoe-yoke-plans-portaging/.

* cited by examiner

WATERCRAFT PORTAGE APPARATUS AND METHOD OF USE

FIELD OF THE INVENTION

The disclosure relates to a system for aiding a carrier of a canoe or other watercraft. More particularly, the disclosure relates to a portage assist apparatus that combines aspects of strength, ease of installation, and ease of storage.

BACKGROUND

Canoeing is a popular paddling pastime in the United States, with an estimated 9.1 million participants. Trips are often short, from one to twenty-five miles.

SUMMARY

Manually transporting canoes for longer trips is often very difficult. Canoes are often heavy, and even lighter canoes are bulky and tough to carry alone. Any system to aid in the transport of canoes must be heavy enough to hold up the weight of the canoe, but also ergonomically designed such that a user is comfortable using it. Existing systems are sometimes complicated and heavy to carry around.

Accordingly, it would be advantageous to provide a sturdy, easy to transport system for a canoe that is also comfortable for a single user.

What is desired is a system that allows a user to easily transport a canoe that is compact and easy to install. It is further desired that such a system be sturdy enough to carry the weight of a canoe, but also comfortable enough to rest on the shoulders of the user.

In one configuration, a watercraft portage apparatus is provided comprising a substantially rigid elongated member having sufficient strength to support a watercraft having a weight of at least 15 pounds, the elongated member having a length greater than the breadth of the watercraft, and having a width. A cushioning member extending along at least a portion of the length of the elongated member can act as a nexus between the elongated member, the watercraft, and the user. The cushioning member and the elongated member together form an assembly configured to transfer the weight of the watercraft to the user. At least one connector can be configured to temporarily join the elongated member to the watercraft. The connector, which can be an elastic cord such as a bungee cord, can be configured to attach to itself, and can do so via a suitable mechanism, including but not limited to a buckle strap, a hook-and-loop fastener, a ratchet strap, a bungee cord, and/or a hook.

The cushioning member can be configured to surround the perimeter of the elongated member. The elongated member can have a rectangular cross section, or circular cross section, and can be made of carbon fiber, wood, metal, a thermoplastic material, a thermoset material, and/or another material having sufficient rigidity and strength to support the weight of a watercraft. In embodiments, the elongated member can have sufficient strength to support a static load of at least 15 pounds, and the cushioning member can have resilience to allow for comfortable load bearing on a user. The elongated member can be fastened to the watercraft in a way such that the elongated member does not move. In some cases, the elongated member can be fastened to the cushioning member in such a way to allow movement of the cushioning member about the elongated member, while in other cases the cushioning member and elongated member can be connected in such a way as to not allow movement of the cushioning member about the elongated member in a rotational or axial movement. A connector, which can be a material including an elastic strap or cord, or a non-elastic strap or cord, can be configured to directly join the elongated member to the load, and in most cases is at least 20 inches in length when configured to connect the watercraft portage apparatus to the watercraft. The connector can withstand a force equal to or greater than the weight of the watercraft. The elongated member can use its terminal ends to support the connector utilizing a notch, a hole, a ratchet strap, a buckle strap, a hook, and/or a hook-and-loop fastener. In embodiments, the connector is configured to attach the elongated member directly to the load. In embodiments, the watercraft portage apparatus can be installed for use in 30 seconds to 5 minutes, or 30 seconds to 3 minutes, or 30 seconds to 1 minute. In embodiments, the watercraft portage apparatus can be removed from a watercraft within 20 seconds to 3 minutes, or 20 seconds to 2 minutes, or 20 seconds to 1 minute, and can be easily stored either in the watercraft or nearby the watercraft without an undue obstacle.

In some cases, the elongated member can include at least one extendable portion. This elongated member can include at least one rotating, sliding and/or clamping telescoping tightening mechanism, which can allow for the extendable portion to retract and extend from the elongated member.

In some embodiments, the elongated member has a straight configuration. In other cases, the elongated member can be a curved member made of non-limiting materials including wood, carbon fiber, metal, a thermoplastic material and/or a thermoset material.

Another embodiment is a method of installing the watercraft portage apparatus or yoke comprising obtaining the apparatus, which comprises an elongated member, a cushioning member, and a connector, orienting the apparatus on the watercraft, and attaching the apparatus to the watercraft. This attachment is accomplished by using the connector which secures the yoke to the load. In this method, the connector can be an elastic strap or cord, or a non-elastic strap or cord. In some cases, the cushioning member is detachable from the elongated member and the entire apparatus will enable a user to lift and carry the load using the watercraft portage apparatus as support to a user.

In a further configuration, a portage apparatus is provided comprising a substantially rigid elongated member having sufficient strength to support a static load of at least 20 pounds, the elongated member having a length greater than or equal to the breadth of the load at a suitable attachment point on the load, and having a width. A cushioning member extending along at least a portion of the length of the elongated member can act as a nexus between the elongated member, the load, and the user. The cushioning member and the elongated member together form an assembly configured to enable the static load to be transferred to a user. At least one connector can be configured to temporarily join the elongated member to the load. The connector, which can be an elastic cord such as a bungee cord, can be configured to attach to itself, and can do so via a suitable mechanism, including but not limited to a buckle strap, a hook-and-loop fastener, and/or a hook.

Other features and advantages of the disclosed embodiments will become more apparent from the accompanying drawings and descriptions of the preferred embodiments.

BRIEF DESCRIPTION OF THE DRAWINGS

FIG. 13A-13D show non-limiting examples of possible side views of the cushioning member for embodiments disclosed herein.

DETAILED DESCRIPTION

Figure 1:
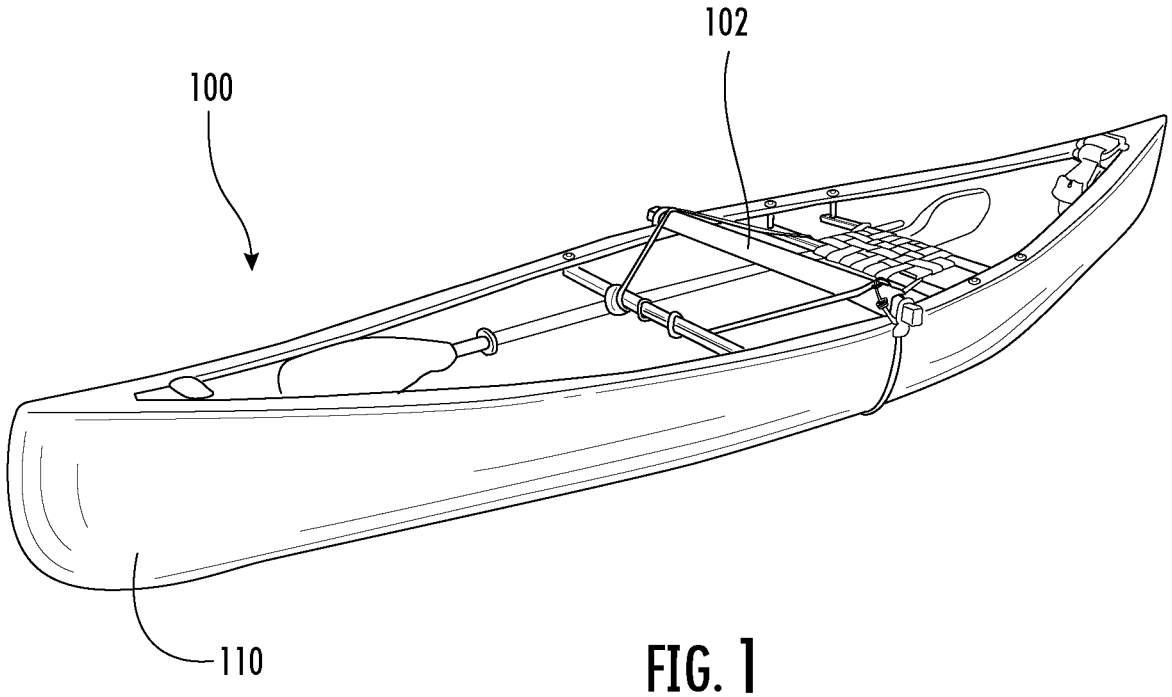
FIG. 1 is a diagram of a portable watercraft yoke installed on a canoe from an orthographic view according to a first embodiment.
Figure 2:
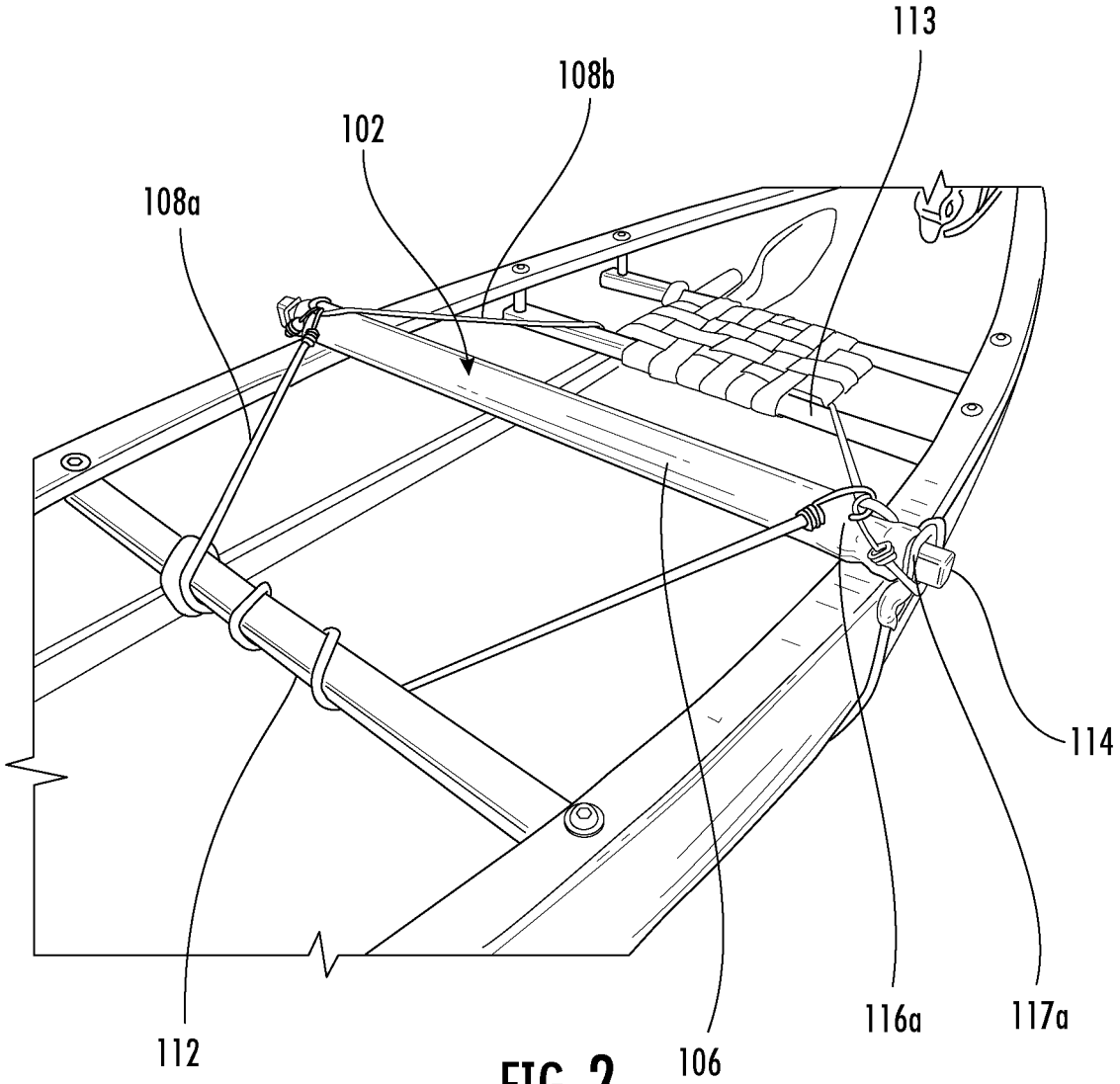
FIG. 2 is a diagram of the portable watercraft yoke installed on a canoe from a close-up orthographic view according to the first embodiment.
Figure 3:
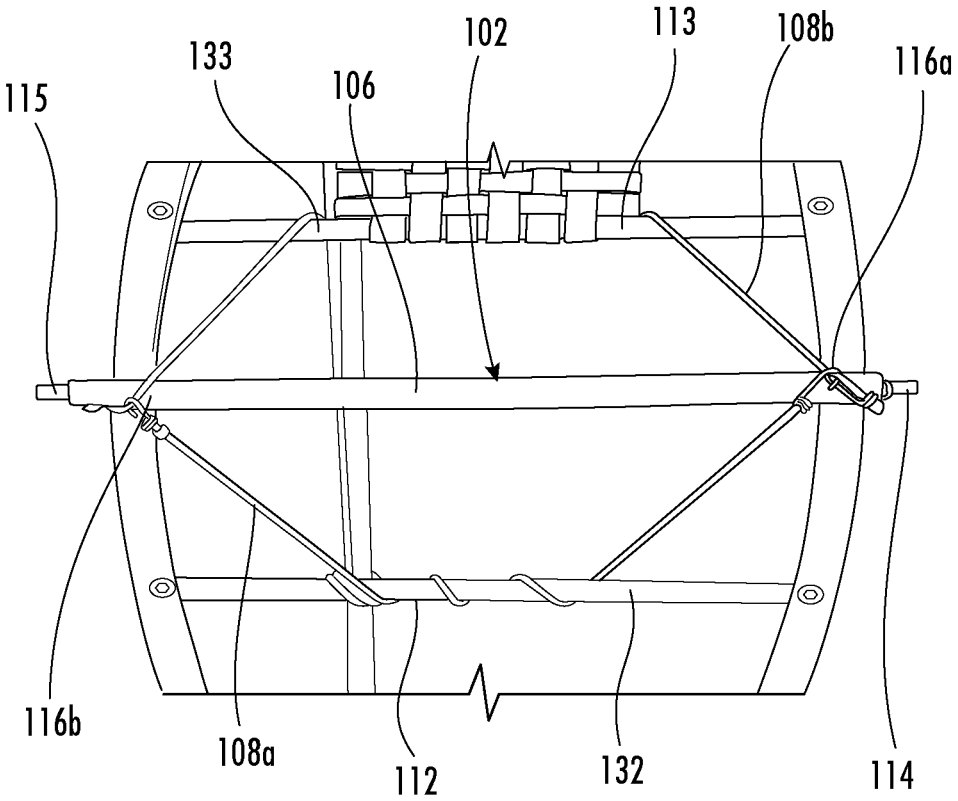
FIG. 3 is a diagram of the portable watercraft yoke installed on a canoe from a top-down view, according to the first embodiment.
Figure 4:
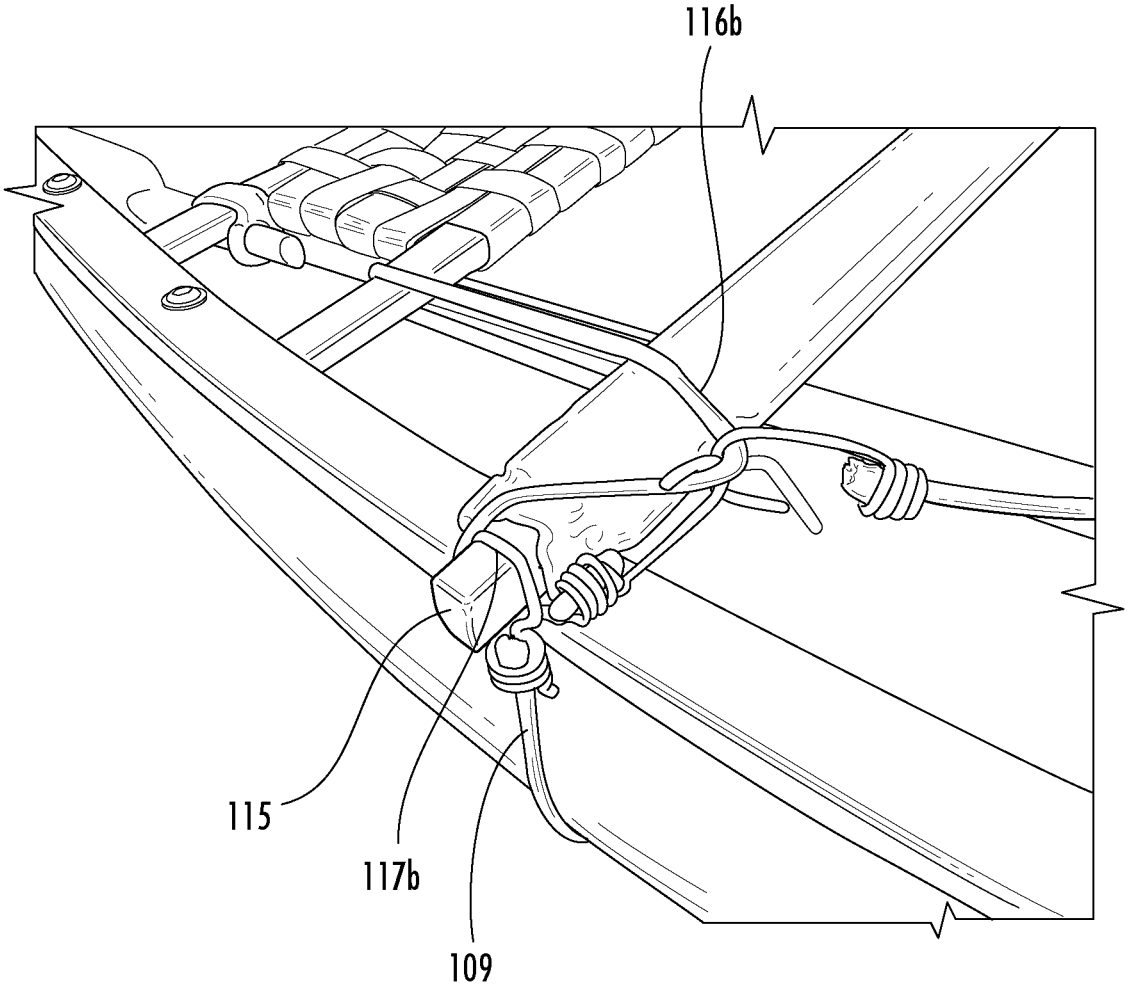
FIG. 4 is a diagram of a connection point between the portable watercraft yoke and the canoe according to the first embodiment.
Figure 5:
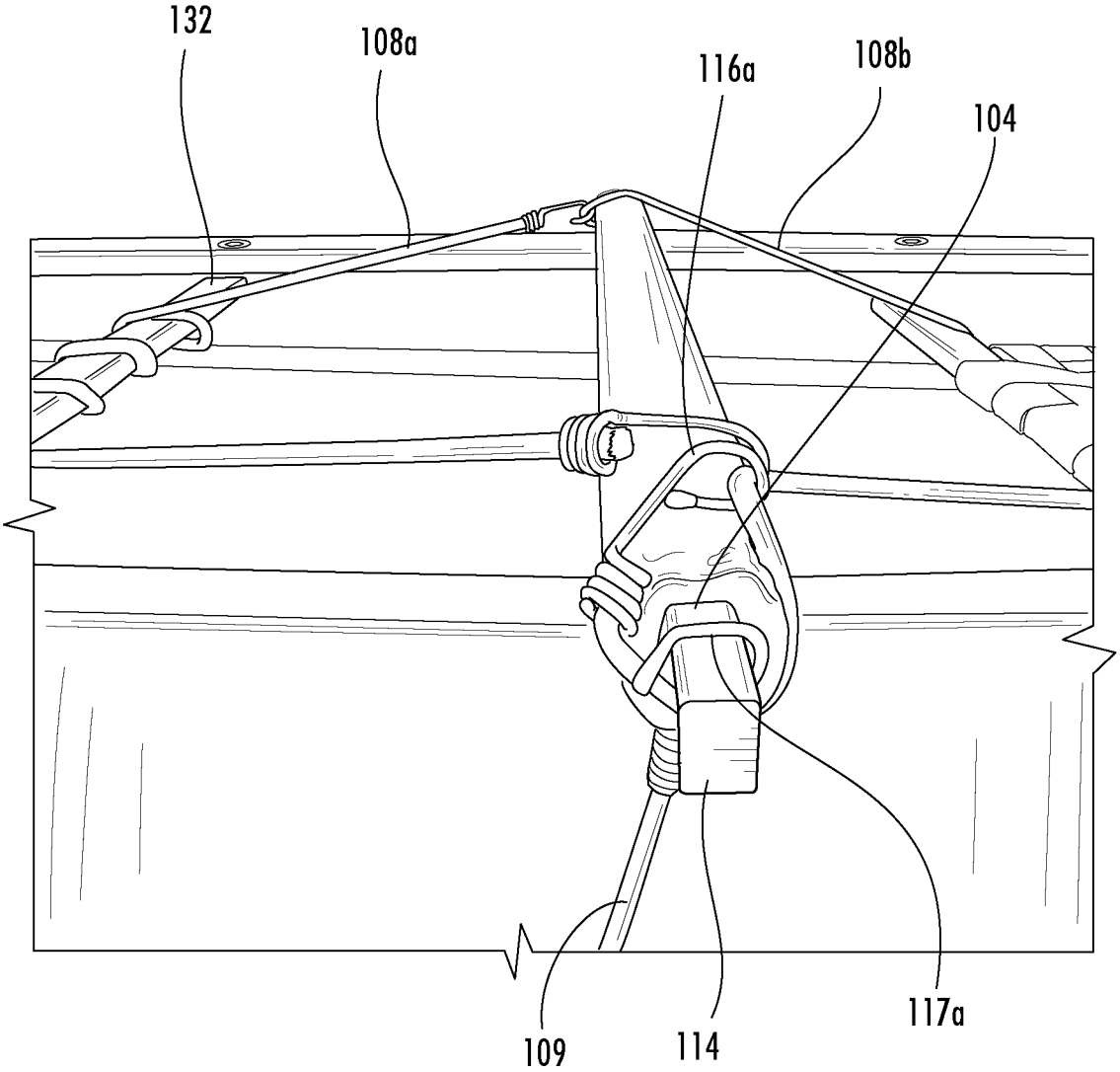
FIG. 5 is a diagram of the portable watercraft yoke installed on a canoe from a side view, according to the first embodiment.

Referring now to the drawings, wherein like reference numbers designate corresponding structure throughout the views:

FIGS. 1-5 show a system 100 that includes a portable watercraft yoke 102 installed on a portable watercraft, such as a canoe 110, according to the first embodiment. The portable watercraft yoke 102 yoke can used for watercraft portage over land between bodies of water. The portable watercraft yoke 102 includes a substantially rigid elongated member 104, which can have a cross section that is rectangular, circular, oval-shaped or oblong. In embodiments, the elongated member 104 can have a length of 16 inches to 44 inches, 20 inches to 40 inches, or 24 inches to 36 inches. In embodiments, the elongated member 104 can have a width or diameter (in the horizontal direction as shown in FIG. 5) in the range of ⅓ inch to 1½ inch, or ½ inch to 1¼ inch, or ¾ inch to 1 inch. In embodiments, the elongated member 104 can have a thickness or diameter (in the vertical direction for the embodiment shown in FIG. 5) in the range of ⅓ inch to 1½ inch, or ½ inch to 1¼ inch, or ¾ inch to 1 inch. A cushioning member 106 extends along at least a portion of the length of the elongated member 104, serving as an outer lining for the elongated member 104. The cushioning member 106 can be fixed to the elongated member 104, or can surround the elongated member 104 to be permitted to slide off the elongated member 104 from at least one end, or from the side. In some cases, the cushioning member 106 can rotate around the perimeter of elongated member 104. The elongated member 104 is sufficiently rigid in order to support the weight of the load e.g., a portable watercraft, such as a canoe, kayak, rowboat, water inflation device, or other type of boat, etc. 110, but in some embodiments may have slight resilience or semi-rigidity in order to increase the comfort on the user while carrying the load, such as a canoe 110. The elongated member 104 must be able to support the weight of the load, which can be 15 pounds or more, or 20 pounds or more, but can still can have enough flexibility for comfort to the user.

Spanning the canoe 110, the elongated member 104 can be seen to be secured by several connectors at its first terminal end 114 and second terminal end 115. The attachment points on the elongated member 104 can comprises a variety of shapes to secure the connectors. In some cases, the connector is one or more elastic cords. In the embodiment shown, there is a first connection point 116*a* and a second connection point 117*a* that the connectors can secure onto proximate the first terminal end 114 of the elongated member 104, and a third connection point 116*b* and a fourth connection point 117*b* proximate the second terminal end 115 of the elongated member 104. In other cases, these connection points can comprise different ways to secure the connectors, including but not limited to holes, notches, eye hooks, and brackets. In the embodiment shown in FIGS. 1-5, a first connector 108*a* is configured to temporarily join the elongated member 104 to the load 110, starting at a first connection point 116*a*, going through a first stabilization point 112 on a horizontal bar 132 extending breadthwise across the canoe 110 on the forward portion of the canoe 110, and attaching to the third connection point 116*b*. A second connector 108*b* is configured to temporarily join the elongated member 104 to the canoe 110, starting at the first connection point 116*a*, going through a second stabilization point 113 on a horizontal bar 133 extending breadthwise across the canoe 110 on the rearward portion of the canoe 110, and attaching to the third connection point 116*b*. A third connector 109 is configured to temporarily join the elongated member 104 to the canoe 110, starting at the second connection point 117*a*, going around the bottom side exterior of the load 110, and attaching to the fourth connection point 117*b*.

In embodiments, the cushioning member 106 has a length that covers about 30% to about 100%, or about 40% to about 95%, or about 50% to about 90% of the length of the elongated member 104. A longer cushioning member 106 would prevent the harder elongated member 104 from damaging or scratching the canoe 110. In some cases, the cushioning member 106 will not cover the entire elongated member 104, at which point the cushioning member 106 is positioned to grant the most comfort to the user. In other cases, the cushioning member 106 may be removable, which will allow the user to adjust the positioning for comfort, as well as clean the cushioning member 106. An attached cushioning member 106 will allow for easier transportation and use of the apparatus with less items to keep track of. The cushioning member 106 can also be split into discrete sections at different points along the elongated member 104, allowing for the capability of both protecting the load at the points of contact with the hard elongated member 104 (or protecting the elongated member at the points of contact with a hard load) and by granting comfort to the user during transport. For example, the cushioning member 106 can include a central section configured to contact the shoulder and/or neck of a person portaging a watercraft, and end sections configured to provide a barrier layer between the elongated member 104 and the sides of canoe 110 to prevent scratching or other damage to the elongated member 104 and/or the canoe 110.

The cushioning member 106 comprises a resilient material or combination of materials including foam and/or non-foam (solid) materials. Suitable materials include, but are not limited to, polyethylene, polypropylene, polyurethane, ethyl vinyl alcohol (EVA), polyester, polyimide, polyamide such as Nylon, latex, ionomer, or other thermoplastic or thermosetting foam polymer, including memory foam. The cushioning member 106 can also be other resilient materials that are not foam, including cloth, wool, cotton, etc. In embodiments, the cushioning member 106 has a thickness in the range of about 0.25 inches to about 2 inches, or about 0.5 inches to about 1.5 inches, or about 0.75 inches to about 1 inch. In embodiments, the cushioning member 106 can be a length the same as the elongated member 104, i.e. 16 inches to 44 inches, 20 inches to 40 inches, or 24 inches to 36 inches if the cushioning member 106 extend the entire length. If the cushioning member 106 is detachable and not the same length as the elongated member 104, in embodiments the length can be 12 inches to 32 inches, 16 inches to 28 inches, or 20 inches to 24 inches.

In embodiments, the cushioning member 106 comprises a resilient material. This resilience can range from 20% to 80%, or 30% to 70%, or 40% to 60%. The support factor of this resilient material can be measured by the ASTM-D3574 test. This test, calculating the ratio of the load bearing capacity between 65% indentation force deflection (IFD) and 25% IFD, can be in a range of 1.5 to 2.6, or 1.75 to 2.5, or 2 to 2.4. Furthermore, the density of the cushioning member 106 can be 2.5 lbs/ft$^3$ to 3.5 lbs/ft$^3$, or 2.7 lbs/ft$^3$ to 3.3 lbs/ft$^3$, or 2.9 lbs/ft$^3$ to 3.1 lbs/ft$^3$.

In some cases, the portable watercraft yoke 102 is in direct contact with the load. This can either be direct contract with the cushioning member 106 or, if the cushioning member 106 is not long enough, in direct contact with the load 110. In some embodiments, in the absence of a cushioning member 106 spanning end-to-end, brackets can be mounted to the load 110 to create a spacer between the load 110 and the yoke 102. This spacer is used to cradle the yoke 102 to prevent damage to the watercraft. A spacer can include but is not limited to a soft material to act as a barrier or a bracket mount that secures to the load 110 and cradles the yoke 102.

The first connector 108*a*, second connector 108*b* and third connector 109 are designed to secure the rest of the yoke assembly 102 to the load 110 at the connection points 116*a*, 116*b*, 117*a* and 117*b*. The connector type can be but is not limited to an elastic strap, a ratchet strap, a buckle strap, or a hook-and-loop fastener such as VELCRO®. In some cases, the connectors are elastic cords having hooks at each end, such as bungee cords. In embodiments, the inside connectors can stretch to a range of 20 inches to 54 inches, 25 inches to 45 inches, or 30 inches to 36 inches in order to secure the portable watercraft yoke 102 to the load 110. This length is described at the length of the connector when attached to the load 110 and stretched in a manner that is not loose and in position to safely use the yoke 102. The third connector 109 that stretches around the outside of the load 110 can stretch to a length of 30 inches to 78 inches, or 42 inches to 72 inches, or 54 inches to 66 inches when stretched around the load 110.

Figure 6:
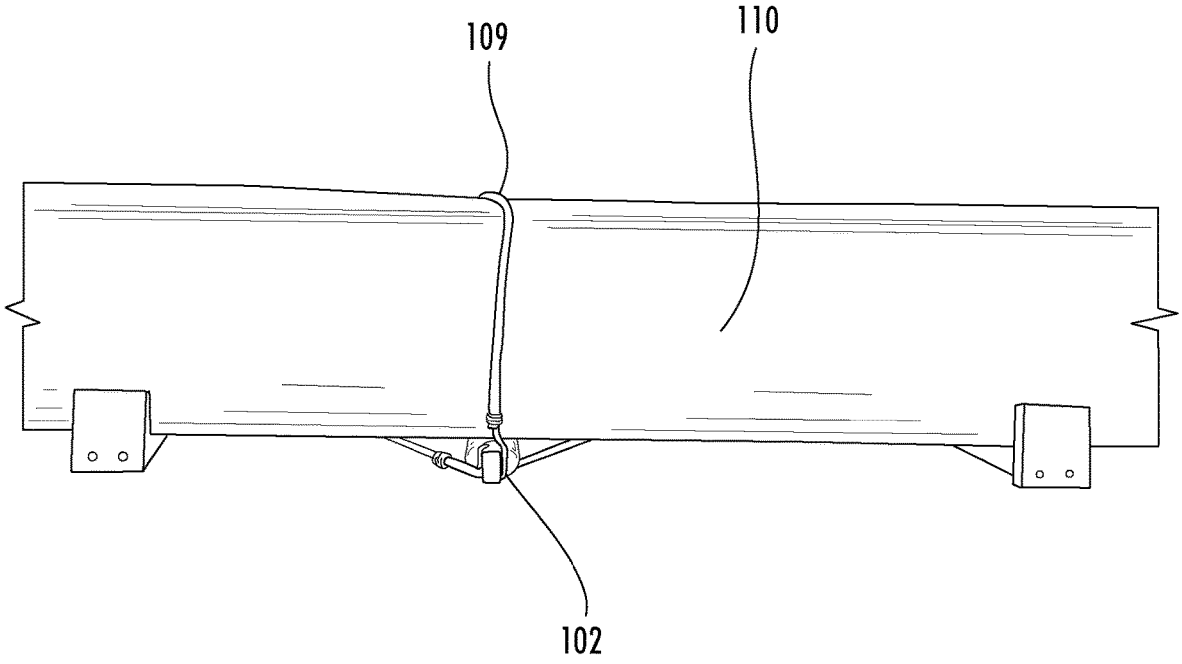
FIG. 6 is a diagram of a canoe being stored installed with the portable watercraft yoke according to the first embodiment.

FIG. 6 is a diagram of the canoe 110 being stored with the portable watercraft yoke 102 installed according to the first embodiment. The portable watercraft yoke 102 can easily stay on the canoe 110 in storage. In some embodiments, a user may choose to remove the portable watercraft yoke 102 before storing the canoe 110. The connector 109 can also be seen to go around the load 110 in order to secure the yoke 102.

In embodiments, the portable watercraft yoke 102 is employed to enable a user to conveniently lift and carry a watercraft over land. First, the user will gather up all the materials in the portable watercraft yoke 102, including the elongated member 104, the cushioning member 106, and at least one connecter 108*a*, 108*b*, or 109. Next, the portable watercraft yoke 102 is placed on the load where it will eventually be secured. If it is not already attached because it is removable, the cushioning member 106 can be secured to the elongated member 104. The next step is to attach the connectors to the yoke 102 by going through stabilization points on the load 110 and connecting to the connection points 116*a* and 116*b* or 117*a* and 117*b*. The connectors can be easily removed from the connection points 116*a* and 116*b* or 117*a* and 117*b* at the end of use. After connection, the load can be lifted by the portable watercraft yoke 102 as support to the user, including to areas such as the shoulder, back, and neck.

The outside connector 109 can also be attached to the connection points 117*a* and 117*b* before placing on the load 110. If this method is used, the intermediate of the elongated member 104 and outside connector 109 can be slid onto the load 110 until the outside connector 109 is sufficiently tight and elongated member 104 at the desired point of connection.

FIG. 7 is a set of diagrams depicting a telescoping yoke system 200 configured to enable an individual person to carry the load 110. This system utilizes an elongated member 204 with a central portion 205 and at least one extendable portion 220 or 221. A cushioning member 206 similar to the cushioning member described in connection with the first embodiment is disposed on the central portion 205. The embodiment of FIG. 7 has a first extendable portion 220 extending from a first end 207 of the central portion 205 and a second extendable portion 221 extending from a second end 209 of the central portion. In embodiments, the center portion 205 can have a length of about 8 inches to about 22 inches, or about 10 inches to about 20 inches, or about 12 inches to about 18 inches. In embodiments, the elongated member 204 can have a width or diameter (in the horizontal direction) in the range of ⅓ inch to 1½ inch, or ½ inch to 1¼ inch, or ¾ inch to 1 inch. In embodiments, the elongated member 204 can have a thickness or diameter (in the vertical direction for the embodiment shown in FIG. 7B) in the range of ⅓ inch to 1½ inch, or ½ inch to 1¼ inch, or ¾ inch to 1 inch.

Figure 7A:
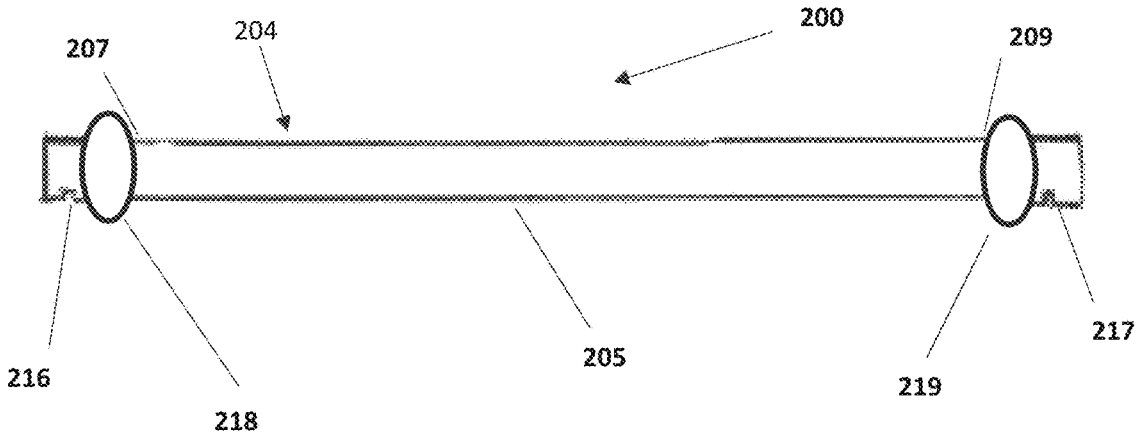
FIG. 7A show a second embodiment of a portable watercraft yoke that has extendable end portions, both of which are shown in a retracted configuration.
Figure 7B:
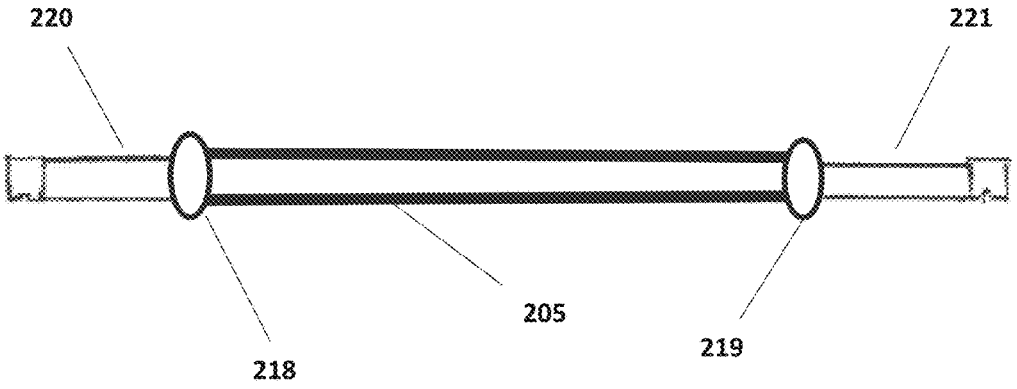
FIG. 7B shows the second embodiment with the extendable end portions illustrated in an extended position.
Figure 7C:
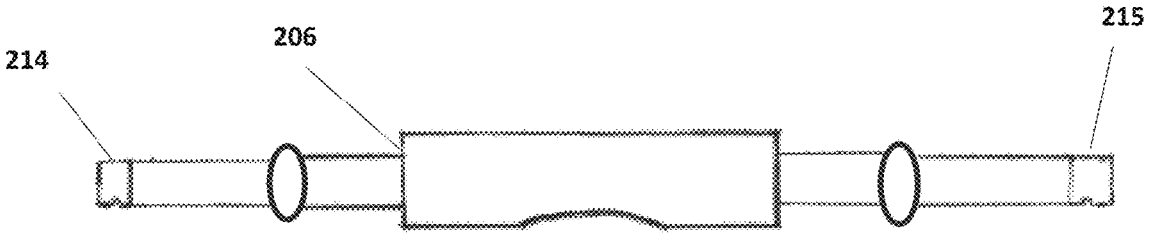
FIG. 7C shows the second embodiment with an alternative configuration of a cushioning portion.
Figure 7D:
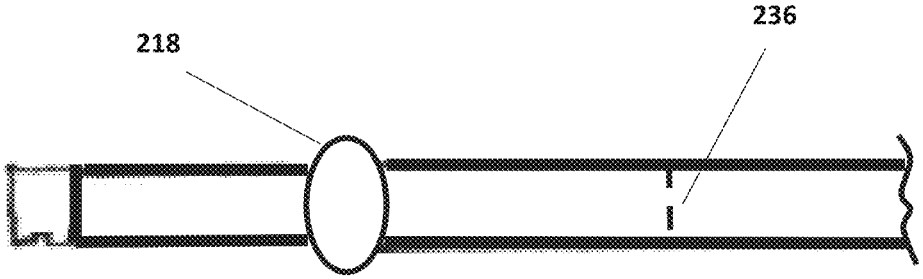
FIG. 7D shows details for the second embodiment.
Figure 7E:
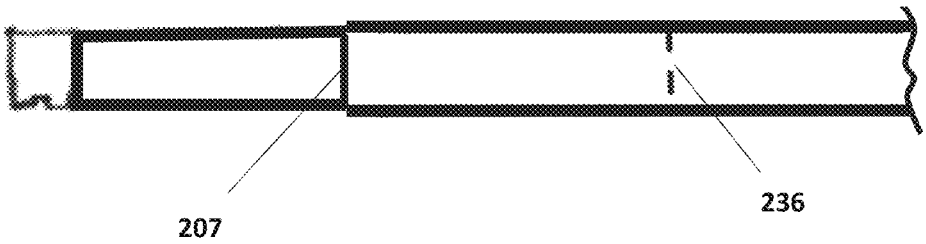
FIG. 7E shows details for the second embodiment with the telescoping mechanism removed.

For embodiments in which the elongated member has a circular cross section, at least one telescopic mechanism 218 that can be rotatable, can be located where the central elongated member 205 overlaps with the first extendable portion 220. In the embodiment shown, there are a first and second telescoping mechanisms 218, 219 at opposing ends of the central portion 205. The first rotating telescoping mechanism 218 can be loosened to permit slidable movement of the first extendable portion 220 relative to the central portion 205, and the second rotating telescoping mechanism can be loosened to permit slidable movement of the second extendable portion 221 relative to the central portion 205. When the telescoping mechanisms are tightened, the slidable positions of the first extendable portion 220 and second extendable portion 221 are fixed to provide the elongated member 204 with a fixed length. The telescoping mechanisms can be made of a thermoplastic material, thermoset material, metal, carbon fiber, or other materials in embodiments. In some cases, the telescoping mechanisms 218, 219 can comprise other securing techniques that may or may not involve rotation, such as the non-limiting examples in FIG. 14, described below. Two connector attachment points 216, 217 can be located on opposing sides of the extendable portions 220, 221, which can comprise carbon fiber or another material, and can be fully extended to the length of the center rigid member 204 above. In embodiments with two extendable portions 220, 221, each portion can extend from 1% to 50%, 5% to 40%, or 10% to 30% the length of the central portion 205. As shown in FIG. 7D and FIG. 7E, the length of overlap between the center portion 205 and the extendable portion 220, 221 is dictated by 236, the end of the extendable portion. The necessary degree of overlap between the center portion 205 with the first extendable portion 220 and the second extendable portion 221 will depend upon the materials used to make the central portion 205, the first extendable portion 220 and the second extendable portion 221, the diameters, lengths and wall thicknesses of these components, and the load that the yoke system 200 is intended to support. In some cases, when the first extendable portion 220 and the second extendable portion 221 are fully extended, and the diameter of the central portion is ½ inches to 1½ inches, the overlap of each with the central portion 205 will be about 2 inches to about 6 inches, or about 2½ inches to about 5 inches, or about 3 inches to about 4 inches.

In this second embodiment, the reason that the elongated member 204 has a plurality of extendable portions is to allow the user to adjust a better fit to the load. The device is particularly well suited to be used for both wide and narrow watercraft. After obtaining the elongated member 204, the user can adjust the extendable portions 220, 221 through the two telescoping mechanisms 218, 219. The user can loosen the telescoping mechanisms 218, 219, allowing extension and compression between the extendable portions 220, 221 and the central elongated member 205. With the elongated member 204 free, the extendable portions 220, 221 can be adjusted to the point where the entire elongated member 204 sits comfortably across the load where the yoke will be secured. When this length is found by the user, the telescoping mechanisms 218, 219 are tightened to prevent future movement of the extendable portions 220, 221. After finding the desirable length of the extending portions, the method of installation and use is generally the same as the method used for the first embodiment as depicted in FIGS. 1-5.

Figure 8:
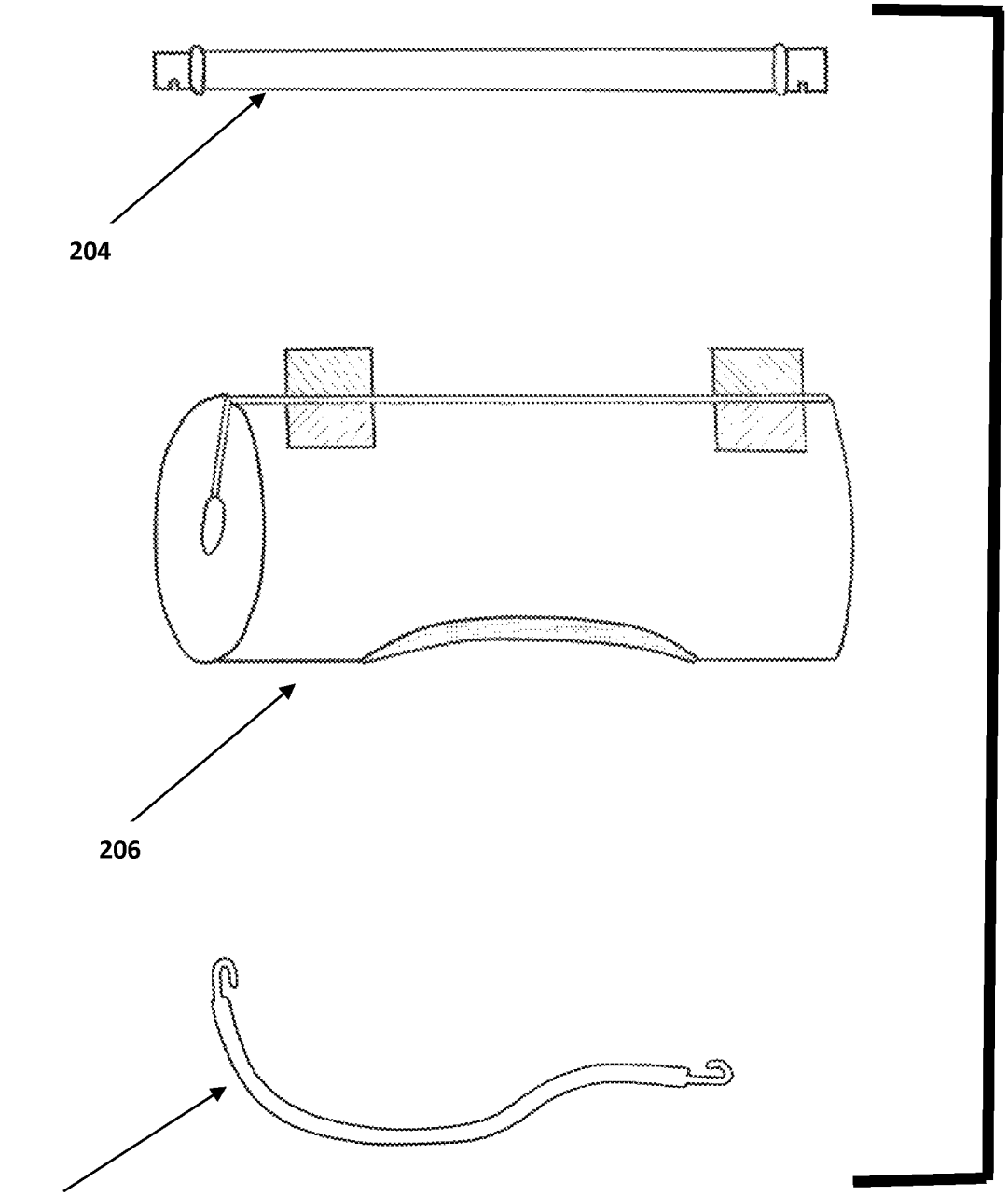
FIG. 8 is a diagram of a third embodiment that is a portable watercraft yoke assembly that includes an elongated member, a cushioning member, and at least one connector to connect the yoke to a portable watercraft.

FIG. 8 is a diagram of the assembly that makes up the portable watercraft yoke. The parts include an elongated member 204, which can be extendable or fixed, a cushioning member 206, which can be fixed or detachable, and at least one connector 108*a*, 108*b*, or 109.

Figure 9:
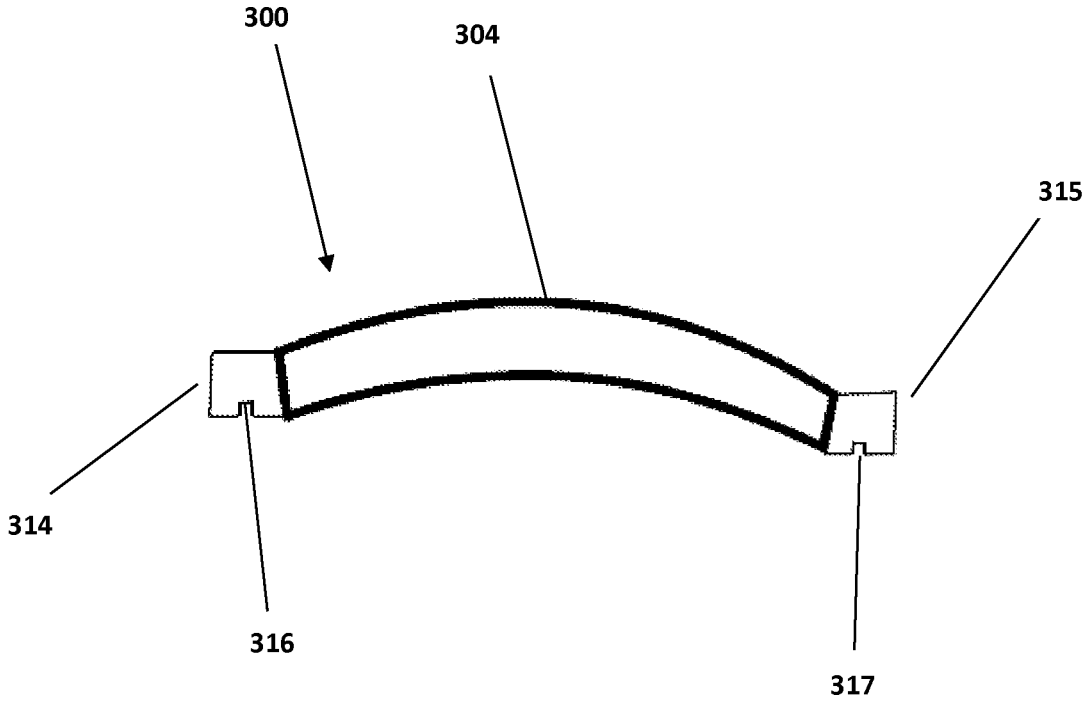
FIG. 9 is a diagram showing a curved elongated member of the portable watercraft yoke according to a fourth embodiment.
Figure 10A:
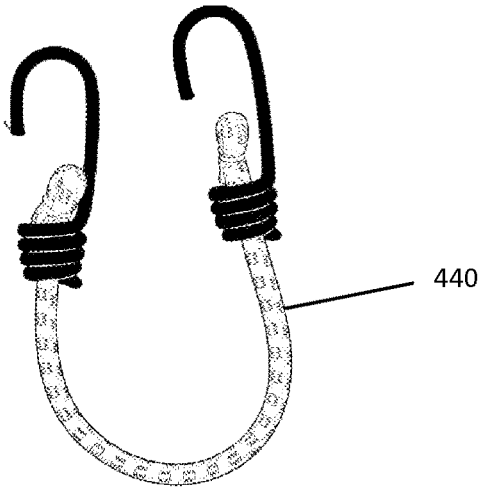
FIGS. 10A-10D show non-limiting examples of possible connectors for embodiments disclosed herein.
Figure 10B:
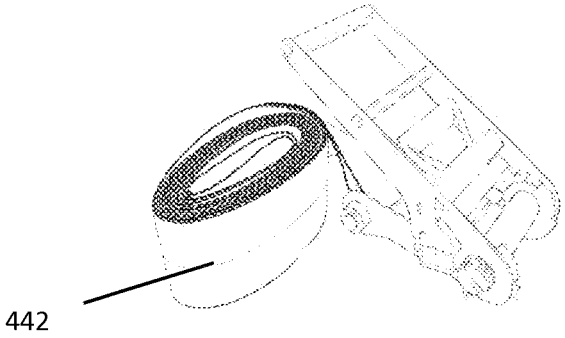
Figure 10C:
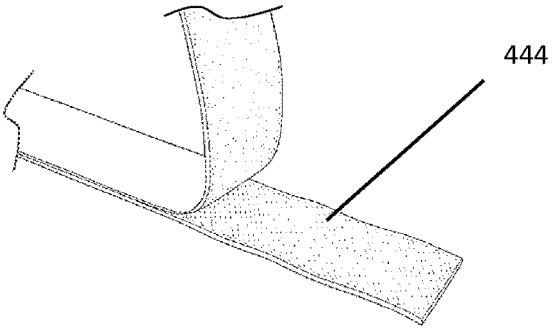
Figure 10D:
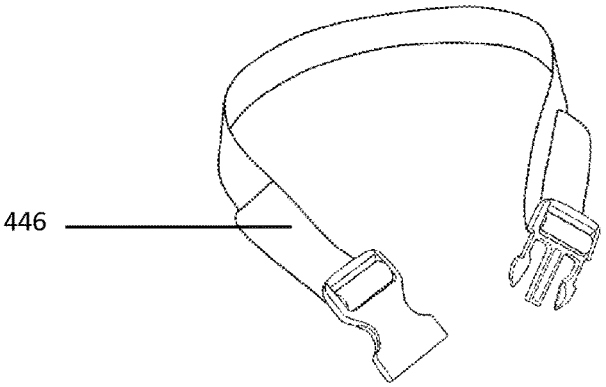
Figure 11A:
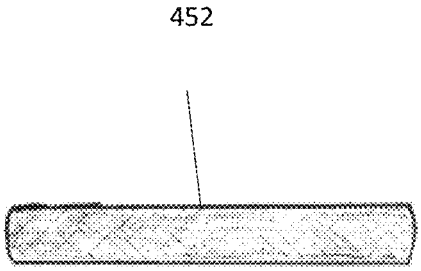
FIGS. 11A-11E show non-limiting examples of possible variations to the cushioning member for embodiments disclosed herein.
Figure 11B:
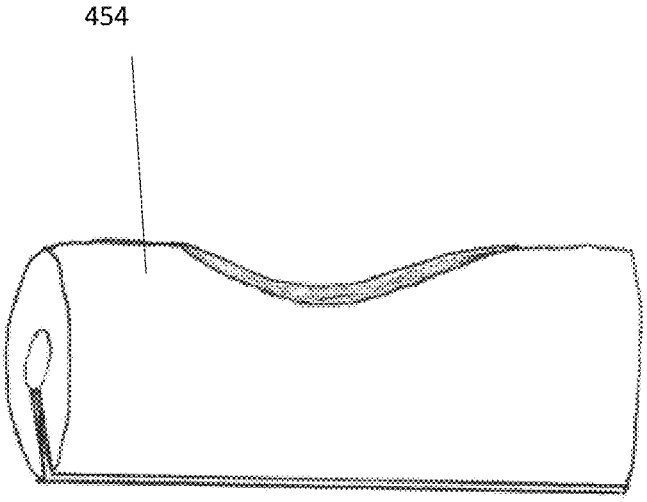
Figure 11C:
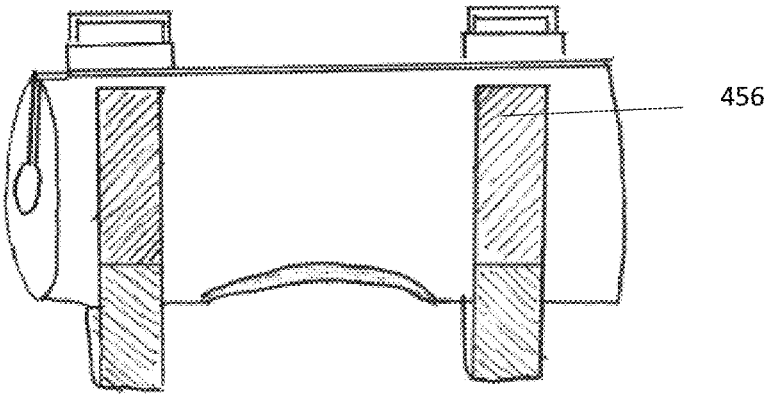
Figure 11D:
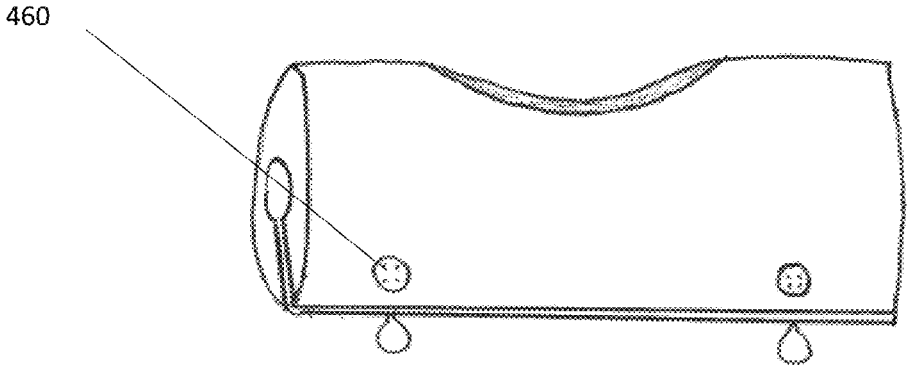
Figure 11E:
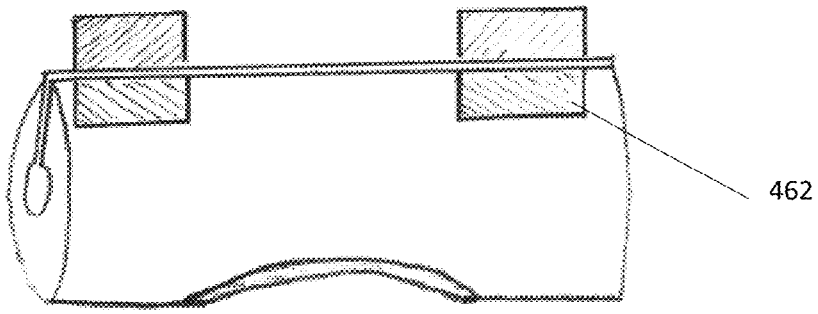

FIG. 9 is a diagram of a curved member of the portable watercraft yoke 300 according to a third embodiment. The curved member 304 can be different materials, including wood, carbon fiber, metal, or plastic. The curved member can also have a cushioning member fitted to the shape of the curved member 304. The length of the curved member 304 is subject to the same specifications as the elongated member 104 described above. The curved member 304 can also have similar terminal ends 314, 315 and attachment points 316, 317 as the first embodiment. The third embodiment will also have a cushioning member similar to that of 106 in previous embodiments, which generally has the same functionalities as the other cushioning members. The method for installing and using this embodiment is generally the same as the first embodiment depicted by FIGS. 1-5.

FIGS. 10A-14D are variations of different parts of the disclosed embodiments. FIGS. 10A-10D depicts different types of connectors, including but not limited to elastic cords designated as 440 in FIG. 10A, ratchet straps designated as 442 in FIG. 10B, hook-and-loop fasteners designated as 444 in FIG. 100, and buckle clamps designated as 446 in FIG. 10D. FIG. 11 depicts variations on the cushioning member, which are included but not limited a simple cover 452 over the elongated member in FIG. 11A or a contoured, detachable cushion 454 in FIG. 11B. The figure further depicts various ways to keep the cushioning member attached to the elongated member which are included but not limited to a buckle strap 456 shown in FIG. 11C, an elastic strap with a button connector 460 shown in FIG. 11D, or a hook-and-loop fastener 462 shown in FIG. 11E.

Figure 12A:
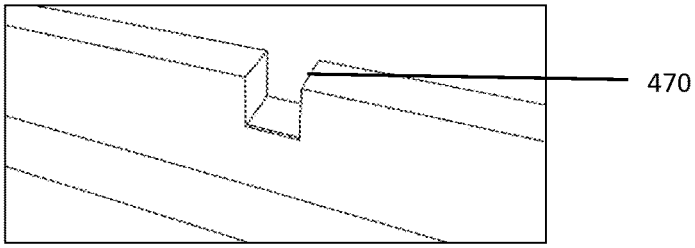
FIGS. 12A-12D show non-limiting examples of possible connection points for embodiments disclosed herein.
Figure 12B:
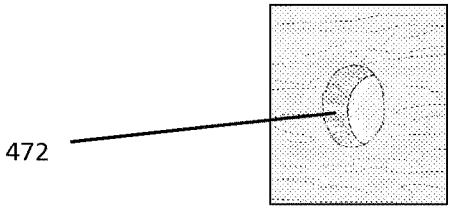
Figure 12C:
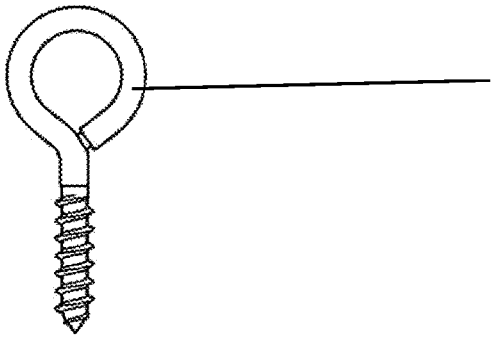
Figure 12D:
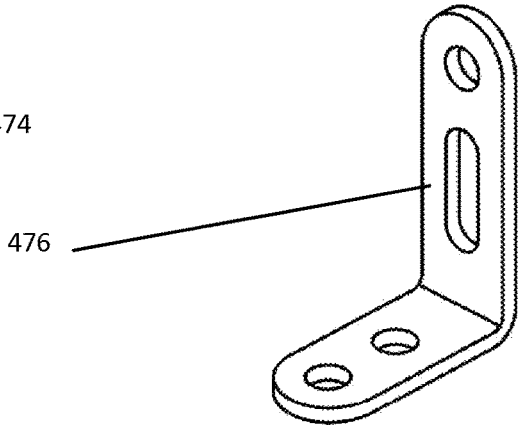
Figure 13A:
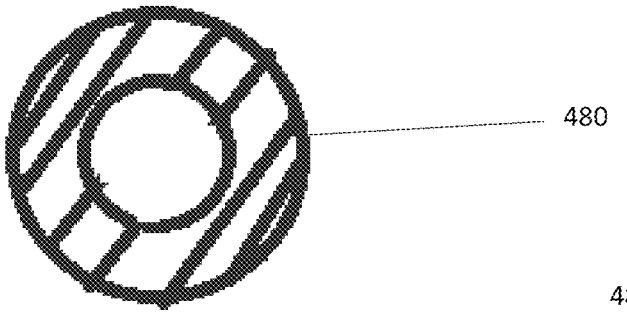
Figure 13B:
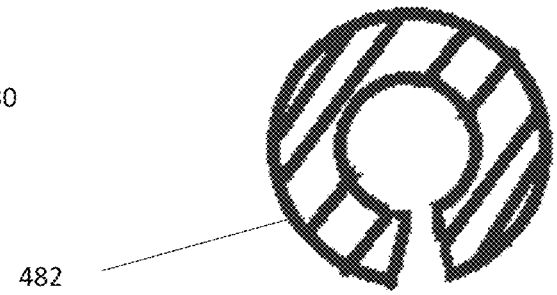
Figure 13D:
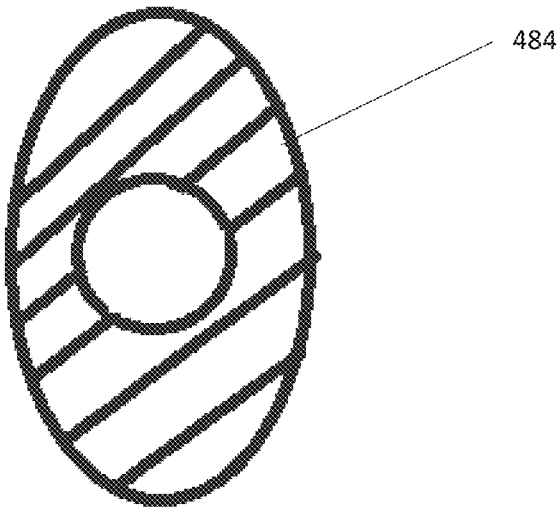
Figure 13D:
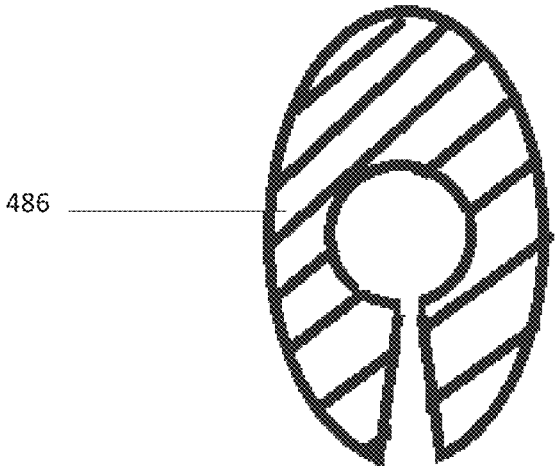
Figure 14A:
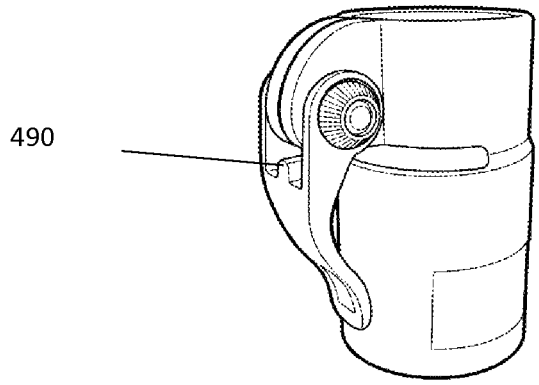
FIG. 14A-14C show non-limiting examples of possible telescoping mechanisms for the second embodiment.
Figure 14B:
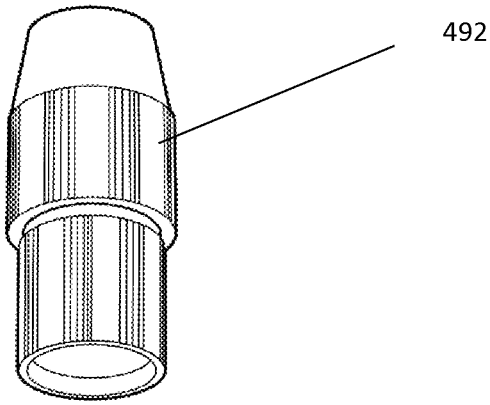
Figure 14C:
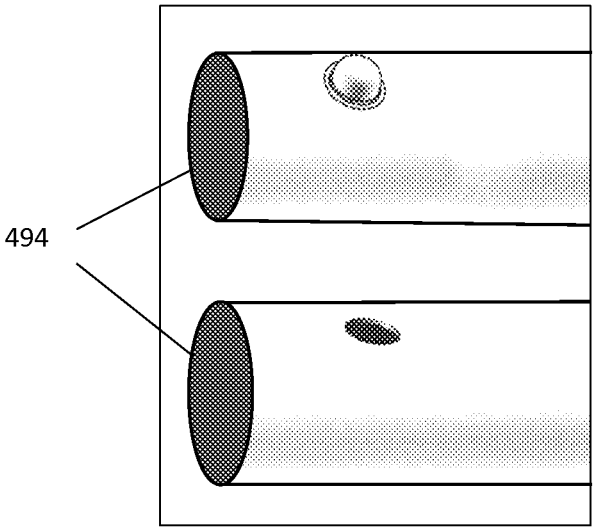

FIG. 12 depicts variations on the connection points of the portable watercraft yoke, which are included but not limited to a notch 470 shown in FIG. 12A, a hole 472 shown in FIG. 12B, a screw eye 474 shown in FIG. 12C or a bracket 476 shown in FIG. 12D. FIG. 13 depicts different cross sections of the cushioning member, which includes but is not limited to a circular cross section 480 shown in FIG. 13A, a circular cross section with a slit 482 shown in FIG. 13B, an oval cross section 484 shown in FIG. 13C or an oval cross section with a slit 486 shown in FIG. 13D. FIG. 14 depicts other variations on the telescoping mechanism of the extendable portions, including but not limited to a clamping mechanism 490 shown in FIG. 14A, a twisting lock 492 shown in FIG. 14B, and a button lock 494 shown in FIG. 14C.

In embodiments, the apparatus is configured to assist a user in carrying portable watercraft that have a weight in the range of about 15 pounds to about 85 pounds, or about 20 pounds to about 70 pounds, or about 25 pounds to about 60 pounds.

A number of alternatives, modifications, variations, or improvements therein may be subsequently made by those skilled in the art, which are also intended to be encompassed by the following claims.

What is claimed is:

1. A watercraft portage apparatus, comprising:

a substantially rigid elongated member having sufficient strength to support a watercraft having a weight of at least 15 pounds, the elongated member having a length greater than or equal to the breadth of the watercraft, and having a width, a cushioning member extending along at least a portion of the length of the elongated member, the cushioning member and the elongated member together forming an assembly configured to transfer the weight of the watercraft to a user, and at least one detachable connector configured to temporarily join the elongated member to a first stabilization point on a first horizontal bar extending breadthwise across the watercraft at a position that is forward from the rigid elongated member, and a second stabilization point on a second horizontal bar extending breadthwise across the watercraft at a position that is rearward from the rigid elongated member, the connector comprising a flexible material configured to secure the elongated member to the watercraft with the elongated member extending in a direction generally parallel to the first horizontal bar.

2. The apparatus of claim 1, wherein the detachable connector is configured to attach to itself via at least one of a buckle strap, a hook-and-loop fastener, a ratchet strap, a bungee cord, and a hook, without requiring the elongated member to be permanently altered.

3. The apparatus of claim 1, wherein the cushioning member is configured to surround the perimeter of the elongated member.

4. The apparatus of claim 1, wherein the elongated member has at least one of a rectangular cross section and a circular cross section.

5. The apparatus of claim 1, wherein the elongated member is made of at least one of wood, metal, carbon fiber, thermoplastic material, and thermoset material.

6. The apparatus of claim 1, wherein the elongated member is fastened to the watercraft in a way such that the elongated member does not move.

7. The apparatus of claim 1, wherein the elongated member is fastened to the cushioning member in such a way to allow movement of the cushioning member about the elongated member that includes at least one of axial movement and rotational movement.

8. The apparatus of claim 1, wherein the elongated member includes a telescoping portion.

9. The apparatus of claim 1, wherein the detachable connector is at least 20 inches in length when attached to the watercraft.

10. The apparatus of claim 1, wherein the detachable connector can support a force at least equal the weight of the watercraft.

11. The apparatus of claim 1, wherein the elongated member can support a detachable connector at its terminal ends by at least one of notches, holes, ratchets, buckles, hooks, and hook-and-loop fasteners.

12. The apparatus of claim 1, wherein the detachable connector and elongated member are removable from the watercraft within 1 minute.

13. The apparatus of claim 1, wherein the detachable connector and elongated member are easily stored in a way that is at least of one inside the watercraft and nearby the watercraft.

14. A method, comprising:

obtaining a watercraft portage apparatus comprising an elongated member, and a cushioning member surrounding the elongated member, obtaining a detachable connector, the detachable connector comprising a flexible material configured to join the elongated member to the watercraft without permanently altering the watercraft, placing the apparatus adjacent to a portable watercraft having a first stabilization point on a first horizontal bar extending breadthwise across the watercraft at a position that is forward from the apparatus, and a second stabilization point on a second horizontal bar extending breadthwise across the watercraft at a position that is rearward from the apparatus, and attaching the apparatus to the first stabilization point and the second stabilization point on the watercraft using the detachable connector to secure the apparatus to the portable watercraft with the elongated member extending in a direction generally parallel to the first horizontal bar.

15. The method of claim 14, further comprising lifting and carrying the watercraft using the elongated member as a support across shoulders of a user.

16. The apparatus of claim 1, wherein the elongated member includes a telescoping portion integrated into the removable elongated member configured for temporary portage attachment.

17. The apparatus of claim 1, wherein the elongated member includes a telescoping portion.

18. The apparatus of claim 1, wherein the connector permits selective positioning of the elongated member relative to the watercraft such that the balance point for portage may be adjusted.

19. The apparatus of claim 1, wherein the elongated member comprises at least one telescoping portion configured to extend or retract to accommodate varying watercraft breadths, and wherein the at least one connector is detachably secured to the elongated member and to the watercraft without requiring permanent modification to the watercraft structure.

20. The apparatus of claim 2, wherein the connector is removably attached to the watercraft without being fully detachable from the elongated member.

* * * * *